US006805114B2

(12) United States Patent
Outten et al.

(10) Patent No.: US 6,805,114 B2
(45) Date of Patent: Oct. 19, 2004

(54) ATTACHMENT FOR GAS GRILL FOR AUTOMATIC BURNER IGNITION AND METHOD

(75) Inventors: Thomas Hobson Outten, P.O. Box 208, Arden, NC (US) 28704-0208; George Steven Hampton, Greenville, SC (US)

(73) Assignee: Thomas Hobson Outten, Arden, NC (US)

( * ) Notice: Subject to any disclaimer, the term of this patent is extended or adjusted under 35 U.S.C. 154(b) by 0 days.

(21) Appl. No.: 10/036,572

(22) Filed: Feb. 22, 2002

(65) Prior Publication Data

US 2003/0159688 A1 Aug. 28, 2003

(51) Int. Cl.[7] ..... F24C 3/12
(52) U.S. Cl. ..... 126/39 E; 126/39 N; 431/12
(58) Field of Search ..... 126/39 E, 39 N, 126/42, 25 A, 25 AA; 431/264, 12; 99/331, 325; 251/279, 213, 348, 345

(56) References Cited

U.S. PATENT DOCUMENTS 2,580,939 A * 1/1952 Meriam ..... 126/39 N
3,664,323 A * 5/1972 Michaels ..... 126/42
4,681,084 A * 7/1987 Grech ..... 126/39 E
5,296,684 A * 3/1994 Essig et al. ..... 219/518
5,611,327 A * 3/1997 Teixeira Filho et al. .. 126/39 R
5,809,990 A * 9/1998 Jones et al. ..... 126/39 N
6,300,603 B1 * 10/2001 Edwards et al. ..... 219/447.1

FOREIGN PATENT DOCUMENTS

JP 10-73256 A * 3/1998 ..... F23C/3/08

* cited by examiner

*Primary Examiner*—Josiah Cocks
(74) *Attorney, Agent, or Firm*—Dority & Manning P.A.

(57) ABSTRACT

An attachment for gas grills with automatic ignition gas burner includes a two-way, plunger actuated valve remotely mounted from the cooking area immediately around the burner. The valve plunger is actuated by an arm or actuator rod B having a pivotal mounting C shielded from the cooking area. Attached to the arm is a ring or actuator member E that provides a large contact area allowing actuation by the periphery of a cooking utensil. Placing the utensil over the burner depresses the ring against the force of the torsion spring D actuating the valve, allowing gas to flow to the burner where it is automatically ignited for cooking. Removal of the utensil closes the valve, shutting off the flow of gas, thus extinguishing the flame at the burner.

18 Claims, 3 Drawing Sheets

ATTACHMENT FOR GAS GRILL FOR AUTOMATIC BURNER IGNITION AND METHOD

BACKGROUND OF INVENTION

This invention relates to an attachment for use on gas grills, and especially to a mechanically actuated ignition burner for saving gas and preserving cooking settings when not in use and method.

U.S. Pat. No. 5,809,990 is representative of the prior art. However, devices constructed in accordance with the patent will not function in actual operation for commercial use. The vertical operating plunger will not move freely through the guide over time because it is positioned centrally of the burner. Grease and food material will bind the plunger, likely in the down position with the burner on. Because the center of gravity is near a point where a handle is attached to a pan, use of a vertical plunger to actuate a valve while keeping the pan center on the burner is precluded because of the weight of the handle being exerted through a relatively long lever arm. Moreover, the pivot point of the horizontal lever would not function in the space provided. Such an arrangement would be thwarted by the center of gravity of the pan.

The prior art is further illustrated by U.S. Pat. Nos. 4,681,084, 5,611,327, and 6,068,471.

SUMMARY OF INVENTION

An attachment for gas grills with automatic ignition gas burners would be especially useful in commercial environments. The attachment includes a valve opened by a pivoted spring biased arm when a cooking utensil is placed on the cooking surface, thus allowing gas to flow to the burner where it is automatically ignited for cooking by existing pilot. The valve is closed by spring action when the utensil is removed, shutting off the flow of gas, thus extinguishing the flame.

The gas attachment operates to extinguish the burner flame when the burner is not in use. This is accomplished by routing the gas to the burner through a normally closed two way valve and then back through the existing on off valve. The two way valve remains closed until a cooking utensil is placed on the burner. This placement moves an actuator pivot arm that depresses an actuator plunger on the two way valve, thus opening the valve to allow the flow of gas to the burner. The gas is then ignited by a pilot. The burner remains lit until a utensil is removed and the pivot arm is raised above contact with the plunger and the two way valve returns to the closed position blocking the flow of gas to the burner.

Accordingly it is an important object of the invention to provide automatic ignition that ignites the gas burner when a cooking utensil is in position for cooking and extinguishes the gas burner when the utensil is removed for limiting gas consumption during off times.

Another important object of the invention is the provision of a fully mechanical apparatus with no need for electricity or electronic components.

Another object of the invention is to provide an attachment so located as to shield moving parts that would otherwise be subject to fouling by the food stuffs associated with the operation of the grill.

Installation of the attachment is possible with little or no modification of the existing grills.

A ring actuator member provides a large area, allowing actuation by the periphery of a cooking utensil.

Another advantage of the invention resides in automatic ignition and extinguishing of the burner without changing the setting of the existing heat control valve thus preserving the cook's heat preference as to the degree of heat provided by the burner. The gas flame is automatically ignited when the placement of a cooking utensil on the actuator member to resume cooking.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

An attachment for use in a gas grill, having a burner with a central opening and a pilot, for shutting off the flow of gas extinguishing the flame when a cooking utensil is removed from the burner and for opening the flow of gas for automatic ignition by the pilot when the cooking utensil is placed on the burner includes a mechanically operated valve A having gas inlet and gas outlet ports, and being positioned on the grill remote from the burner. A valve actuator arm B, pivotally mounted as at C closely adjacent one end in laterally spaced relation to the valve, extends laterally and is biased upwardly by the spring D on the other end toward the burner. An actuator member E is supported by the other end of the valve actuator arm above the burner for receiving the cooking utensil when placed on the burner. Thus, the actuator arm is preferably pivotally supported adjacent the one end and is spring biased upwardly providing an elongated lever member between the cooking utensil and the valve being of greater length than that portion of the actuator arm in laterally spaced relation to the valve adjacent the one end.

Figure 1:
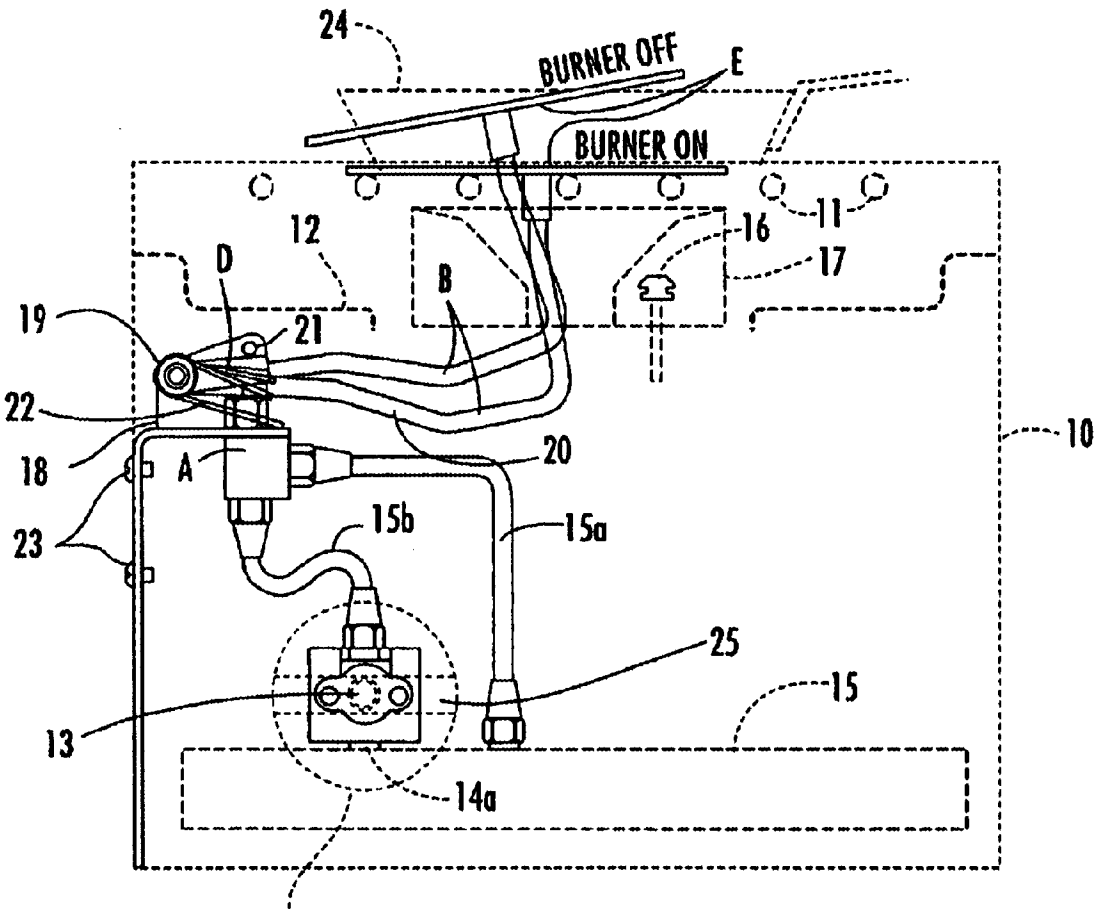
FIG. 1 is a schematic front elevation looking toward the front of a gas grill. Conventional gas grill components are shown in broken lines.
Figure 2:
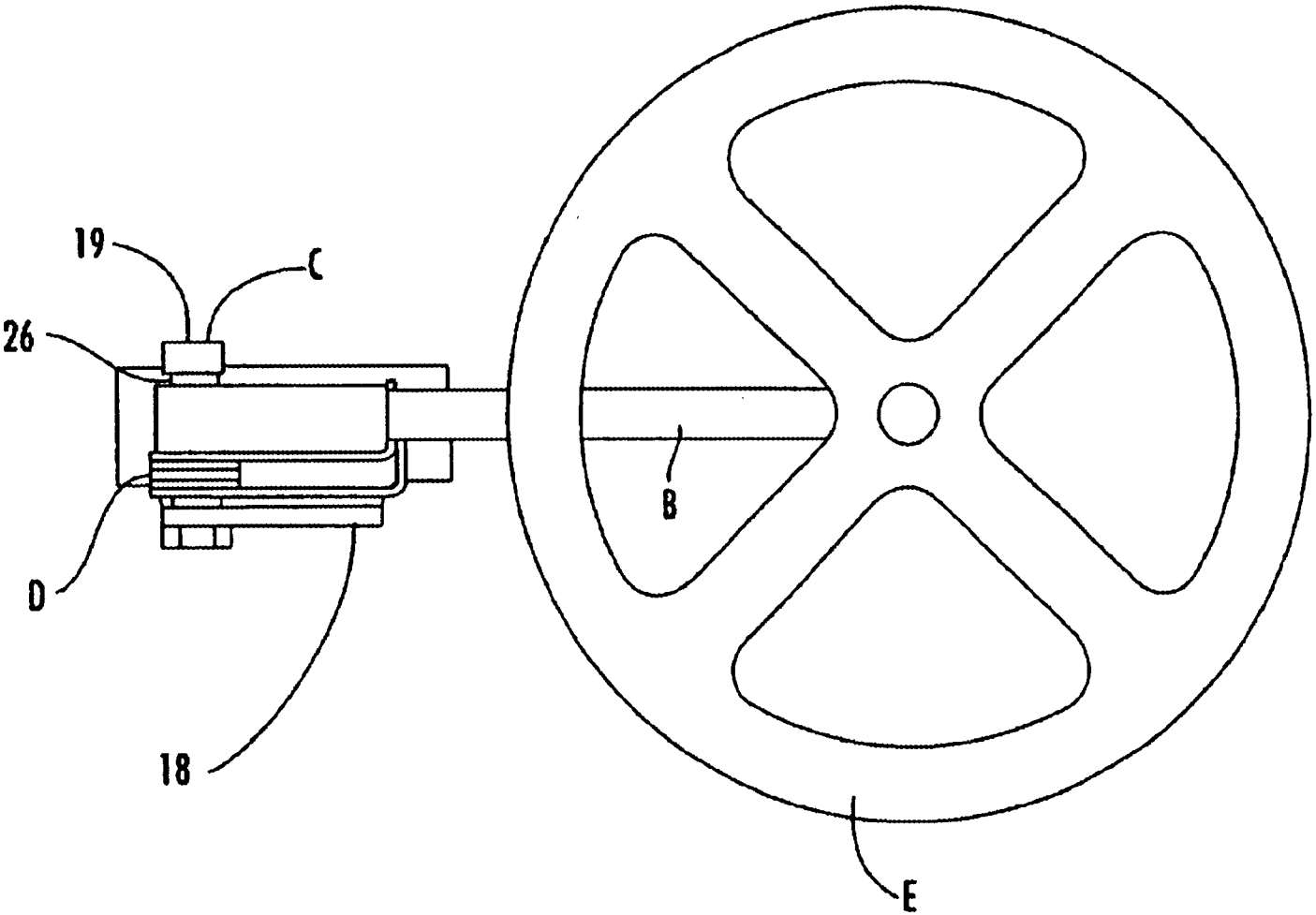
FIG. 2 is a top plan view further illustrating the attachment and method.
Figure 3:
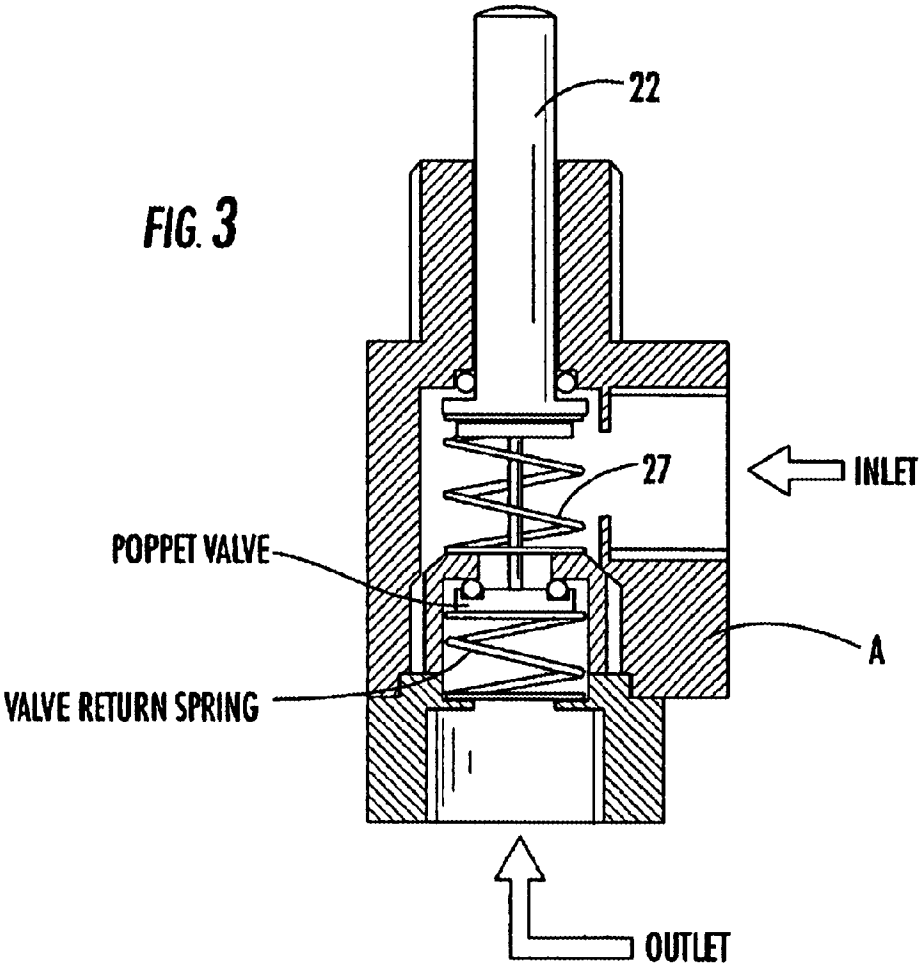
FIG. 3 is a sectional elevation illustrating a suitable valve and method of operation.

Referring more particularly to FIG. 1, an existing grill is illustrated in broken lines, one burner being depicted. Typically, a hot plate grill may have a number of burners.

In the embodiment shown in FIG. 1, the existing grill includes a casing 10, the existing grill 11, the existing drip shield 12, the existing on off knob valve 13, the existing knob 14, the existing gas manifold 15, the existing pilot 16, and the existing burner 17. The location and function of all of these existing parts are not altered by the installation of the attachment constructed in accordance with the invention.

Components of the attachment are fastened to the bracket 18. The components include the pivot bolt 19 that retains the actuator arm or pivot rod B that includes the horizontal component 20. allowing it to pivot. The actuator pivot arm B has its upward travel constrained by the stop bolt 21. The weight of actuator pivot arm B and the actuator ring E are supported above the plunger 22 of the two way valve A by the coil torsion spring D mounted about the pivot bolt 19.

The actuator ring E is in an inclined position to facilitate depression of the actuator arm B responsive to the weight of the utensil 24. The bracket 18 is attached to the grill casing 10 by two mounting screws 23.

The bracket 18 locates the pivot bolt 19 and the two way valve A as far from the center of the existing burner 17 as possible, for positive reaction to the placement of a cooking utensil 24. This location also places these moving parts, which would be vulnerable to fouling from food debris, well under the cover of the drip shield 12.

The knob valve support block 25 supports the existing knob valve after it opens the gas manifold 15 and rotated 180 degrees while maintaining its original position. This valve incorporates a suitable plug 14*a* to plug the manifold and mount the knob valve support block 25.

The gas supply line 15*a* supplies gas from the existing gas manifold 15 to the two way valve A. The controlled gas line supplies gas to the existing knob valve 13. This existing knob valve controls the flow of gas to the burner in the same manner as before the installation of the attachment. The two way valve A interrupts the supply of gas to the knob valve 13 and burner 17. The commercially available normally closed two way valve A blocks the flow of gas when the plunger 22 is extended as is the case when the actuator pivot rod B is supported above the plunger 22. The weight of a cooking utensil 24 placed on the actuator pivot arm 20 depresses the plunger 22. The plunger 22 when depressed opens the valve allowing flow of gas to the existing knob valve 13 and the existing burner 17 where it is ignited by the pilot 16. By extinguishing the burner when not in use without turning the existing knob valve 13 to the off position, gas is conserved, and the cook's temperature setting is not changed. Preserving the temperature setting not only saves the cook time, it also maintains some uniformity of the cooking process.

While a preferred embodiment of the invention is for illustrative purposes only, and it is to be understood that changes and variations may be made without departing from the spirit or scope of the following claims.

What is claimed is:

1. An apparatus for permitting or preventing the flow of gas to a burner having a cooking grill, comprising:

a. a valve having an open and shut position and biased in said shut position;

b. a pivot proximate to said valve;

b. a plunger proximate to said pivot for operating said valve;

c. a valve actuator arm connected to said pivot and in operative contact with said plunger for moving said plunger, wherein said valve actuator arm extends toward the burner;

d. an actuator member having a first position and a second position and connected to said valve actuator arm, wherein said actuator member comprises a substantially fiat surface for receiving a cooking utensil;

e. wherein said actuator member is inclined in said first position and movement of said actuator member moves said valve actuator arm to actuate said plunger and operate said valve.

2. The apparatus of claim 1, wherein said actuator member is substantially horizontal in said second position.

3. The apparatus of claim 1, wherein said actuator member contacts the cooking grill in said second position.

4. The apparatus of claim 1, wherein downward movement of said actuator member moves said valve actuator arm to actuate said plunger and open said valve.

5. The apparatus of claim 1, wherein said actuator member comprises a substantially circular ring for receiving the cooking utensil.

6. The apparatus of claim 1, wherein said valve is laterally separated from the burner.

7. The apparatus of claim 1, further including a spring in contact with said valve actuator arm for biasing said valve actuator arm away from said plunger.

8. The apparatus of claim 1, wherein said plunger is biased away from said valve.

9. The apparatus of claim 1, where said valve actuator arm extends beneath the burner.

10. A method for permitting and preventing the flow of gas to a burner of a gas grill comprising:

a. providing a valve having an open and shut position with a plunger for actuating said valve;

b. biasing said valve in said shut position;

c. connecting a valve actuator arm to said plunger;

d. connecting an actuator member to said valve actuator arm;

e. inclining said actuator member for receiving a cooking utensil;

f. permitting the flow of gas to the burner when the cooking utensil is placed on said actuator member; and g. preventing the flow of gas to the burner when the cooking utensil is removed from said actuator member.

11. The method of claim 10, further including moving said actuator member downward to permit the flow of gas to the burner.

12. The method of claim 10, further including locating said valve laterally separate from the burner.

13. The method of claim 10, further including biasing said plunger away from said valve.

14. A method for permitting and preventing the flow of gas to a burner of a gas grill comprising:

a. providing a valve having an open and shut position with a plunger for actuating said valve;

b. biasing said valve in said shut position;

c. connecting a valve actuator arm to said plunger;

d. connecting an actuator member having a substantially flat surface to said valve actuator arm;

e. permitting the flow of gas to the burner when a cooking utensil is placed on said actuator member;

f. inclining said actuator member for receiving the cooking utensil; and g. preventing the flow of gas to the burner when the cooking utensil is removed from said actuator member.

15. The method of claim 14, further including moving said actuator member downward to permit the flow of gas to the burner.

16. The method of claim 14, further including moving said actuator member upward to prevent the flow of gas to the burner.

17. The method of claim 14, further including locating said valve laterally separate from the burner.

18. The method of claim 14, further including biasing said plunger away from said valve.

* * * * *